US006764216B2

(12) United States Patent
Penato et al.

(10) Patent No.: US 6,764,216 B2
(45) Date of Patent: Jul. 20, 2004

(54) METHOD AND DEVICE FOR X-RAY EMISSION WITH GAS TRAPPING

(75) Inventors: Jean-Marie Penato, Les Essarts le Roi (FR); Pierre Habig, Rambouillet (FR); Patrick Petit, Acheres (FR)

(73) Assignee: GE Medical Systems Global Technology Company LLC, Waukesha, WI (US)

( * ) Notice: Subject to any disclaimer, the term of this patent is extended or adjusted under 35 U.S.C. 154(b) by 43 days.

(21) Appl. No.: 10/261,789

(22) Filed: Sep. 30, 2002

(65) Prior Publication Data

US 2003/0081733 A1 May 1, 2003

(30) Foreign Application Priority Data

Oct. 23, 2001 (FR) ..... 01 13685

(51) Int. Cl.[7] ..... H01J 35/10
(52) U.S. Cl. ..... 378/200; 378/130; 378/141
(58) Field of Search ..... 378/121, 128, 378/130, 141, 199, 200

(56) References Cited

U.S. PATENT DOCUMENTS

| | | | | |
|---|---|---|---|---|
| 4,767,961 A | | 8/1988 | Koller et al. | 313/12 |
| 5,086,449 A | | 2/1992 | Furbee et al. | 378/200 |
| 5,222,118 A | | 6/1993 | Gerth | 378/200 |
| 5,357,555 A | | 10/1994 | Gerth | 378/200 |
| 5,440,608 A | | 8/1995 | Peralta et al. | 378/199 |
| 5,596,622 A | * | 1/1997 | Peralta et al. | 378/199 |
| 5,732,123 A | | 3/1998 | Peralta et al. | 378/200 |
| 6,123,456 A | * | 9/2000 | Lyons | 378/200 |
| 6,254,272 B1 | * | 7/2001 | Dilick | 378/200 |
| 6,286,998 B1 | * | 9/2001 | Dilick | 378/200 |

FOREIGN PATENT DOCUMENTS

| | | |
|---|---|---|
| DE | 4414687 | 11/1995 |
| DE | 4414688 | 11/1995 |
| WO | 9951067 | 10/1999 |

* cited by examiner

*Primary Examiner*—Edward J. Glick
*Assistant Examiner*—Allen C. Ho
(74) *Attorney, Agent, or Firm*—Jay L. Chaskin; Cantor Colburn LLP

(57) ABSTRACT

An X-ray emission device having an X-ray tube and a protective enclosure filled with an electrically insulating liquid in which the X-ray tube is placed. The device includes at least one chamber connected to the protective enclosure that traps and purges gas bubbles contained or dissolved in the liquid filling the protective enclosure.

25 Claims, 3 Drawing Sheets

METHOD AND DEVICE FOR X-RAY EMISSION WITH GAS TRAPPING

CROSS-REFERENCE TO RELATED APPLICATIONS

This application claims the benefit of a priority under 35 USC 119 to French Patent Application No. 01 13685 filed Oct. 23, 2001, the entire contents of which are hereby incorporated by reference.

BACKGROUND OF THE INVENTION

This invention is directed to a method and device for X-ray emission and, more particularly, to a method and device for X-ray emission with gas trapping The device is useful in medical imaging of a body by radiography.

Conventionally, an X-ray emission device comprises an X-ray tube provided with an anode and a cathode subjected to a very high potential difference, up to as much as 150 kV. The X-ray tube is disposed within a protective enclosure. The protective enclosure is filled with an electrically insulating liquid intended to insulate the tube electrically and to cool it on operation, such as electrically insulating oil. The casing of the enclosure is provided with a window through which the X-rays emitted from the tube are delivered out from the emission device.

In operation, the X-rays propagated in the electrically insulating liquid generate, induce, cause, form or maintain in the liquid chemical reactions that produce gases, such as hydrogen, propane, methane, etc. These gases are in a dissolved form in the liquid. However, when the liquid is saturated, gas bubbles are created in the enclosure. These gas bubbles may markedly disrupt or strongly disturb the operation of the device. The presence of gas bubbles alters or impairs the electric insulation qualities of the liquid and can result in a cutoff of emission of the X-rays by appearance of an electric arc short-circuiting the cathode and the anode. The gas bubbles are, furthermore, capable of causing the destruction of some of the components of the device and, in particular, of the X-ray tube.

BRIEF DESCRIPTION OF THE INVENTION

In an embodiment of the invention, an X-ray emission device comprises an X-ray tube and a protective enclosure filled with an electrically insulating liquid, in which the X-ray tube is placed. In an embodiment of the invention, the device further comprises means of elimination or removal or extraction of gas bubbles contained in the liquid filling the protective enclosure.

In an embodiment of the invention, the means for elimination or removal or extraction comprises at least one chamber that traps the gas bubbles in communication with the protective enclosure. An assembly comprising the device and the trapping chamber is movably mounted in a generally circular notion, the chamber trapping the gas bubbles in a region radially inside the chamber, in the course of its displacement.

In an embodiment of the invention, the trapping chamber can be, for example, generally disk-shaped and may be provided with a peripheral cavity equipped with means for purging or draining the chamber. In an embodiment of the invention, when in use, the means for purging the chamber may include a purge valve placed in high position of the trapping chamber, on closure or locking of the chamber.

In an embodiment of the invention, the means for purging of the chamber may include a filtration membrane placed in high position of the trapping chamber, on closure of the chamber, the liquid filling the protective enclosure circulating against one of the faces of the membrane.

In an embodiment of the invention, the chamber is equipped internally with a transverse plate, considering the direction of flow of the liquid entering the chamber, the plate being adjusted to direct the liquid to a peripheral cavity.

In another embodiment of the invention, the means for elimination or removal or extraction of the gas bubbles comprises a conduit element in communication with the protective enclosure and leading to a cavity trapping the gas bubbles, the cavity having a means for purging. An assembly comprising the device and the conduit element being movably mounted in a generally circular motion, the conduit element extending substantially radially inward, considering the path of the device, the conduit element directing the gas bubbles to the trapping cavity in the course of its movement. In an embodiment of the invention, the conduit element is preferably elbowed.

In an embodiment of the invention, the device, the means for eliminating or removal or extraction of the gas bubbles is mounted for cooperation with a means for cooling circuit for the electrically insulating liquid.

In an embodiment of the invention, an X-ray emission device comprises an X-ray tube and a protective enclosure filled with an electrically insulating liquid in which the X-ray tube is placed, the device intended to be moved in operation in a generally circular motion. In accordance with an embodiment of the device, the device comprises a generally disk-shaped gas bubble trapping chamber that is provided with a peripheral cavity equipped with a chamber purge valve.

In an embodiment of the invention an X-ray emission device comprises an X-ray tube and a protective chamber filled with a electrically insulating liquid in which the X-ray tube is placed, the device intended to be moved in operation in a generally circular motion. In an embodiment of the invention, the device comprises a conduit element in communication with the protective enclosure and leading to a gas bubble trapping cavity. An assembly comprising the device and the conduit element is movably mounted in a generally circular motion, the conduit element extending substantially radially inward, considering the path of the device, the conduit element directing the gas bubbles to the trapping cavity in the course of its movement.

In an embodiment of the invention, a method for eliminating or removing or extracting gas bubbles from a liquid of an X-ray emission device movable in operation in a generally circular motion and comprising an X-ray tube and a protective enclosure filled with an electrically insulating liquid in which the X-ray tube is placed. In an embodiment of the method, the liquid filling the enclosure may be continuously removed or drained, the liquid is passed into a gas bubble trapping chamber which is borne by the device which is provided with a peripheral cavity equipped with a chamber purge valve, the device and the chamber it bears are closed or locked, and the chamber is purged or drained.

In an embodiment of the invention, a method of elimination or removal or extraction of gas bubbles from a liquid of an X-ray emission device movable in operation in a generally circular motion comprises an X-ray tube and a protective enclosure filled with an electrically insulating liquid in which the X-ray tube is placed. In the course of operation of the device, the liquid filling the enclosure may be continuously removed or drained, the liquid is passed into a conduit element that extends substantially radially inward, considering the path of the device, which is driven in rotation on an axis of rotation different from the device, which is connected to the protective enclosure and which leads into a gas bubble trapping cavity, the device is closed or locked and the cavity is purged or drained.

BRIEF DESCRIPTION OF THE DRAWINGS

The invention will be better understood from the following description, given solely by way of nonlimitative example and with reference to the appended drawings in which.

DETAILED DESCRIPTION OF THE INVENTION

In an embodiment of the invention, the X-ray emission device cooperates with an X-ray generator for medical diagnosis by radiography. As will be more specifically described, the device is mounted on a movable unit comprising a support or gantry that is movable around a region of a body to be examined.

Figure 1:
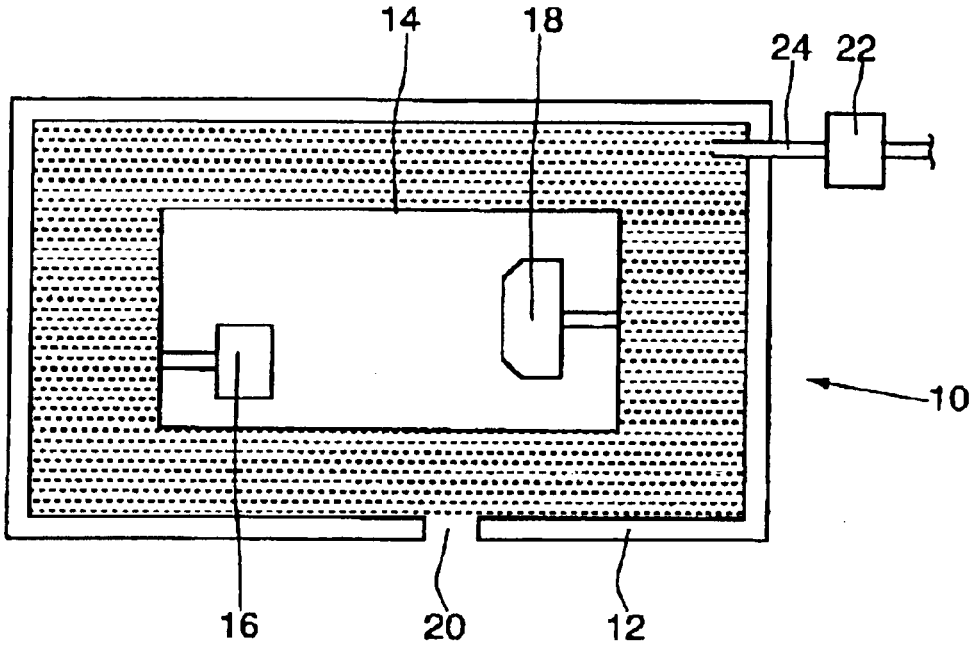
FIG. 1 is a schematic view in longitudinal section of an X-ray emission device according to an embodiment of the invention.

In FIG. 1, the device 10 comprises protective enclosure 12, which may be lead-lined or coated, in which an X-ray tube 14 is placed. The enclosure is filled with an electrically insulating liquid intended for cooling of the device in the course of its operation and for electric insulation of the tube, such as an electrically insulating oil appropriate for the use intended.

The X-ray tube 14 comprises a cathode 16 connected to a high-voltage source in the order of 150 kV, for example, and an anode 18. The anode 18 comprises a disk driven in rotation at high speed, placed in proximity to a window 20 provided in a wall of the enclosure for the exit of X-rays emitted by the anode 18 as a result of an electron bombardment generated by the cathode 16.

Figure 2:
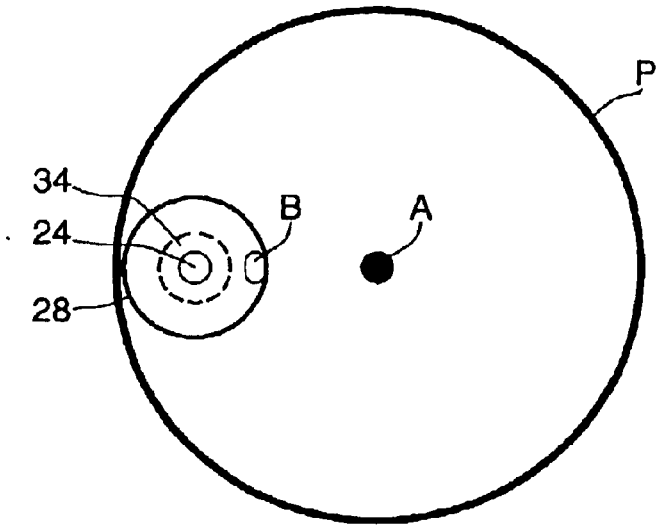
FIG. 2 is a front view of the device of FIG. 1 mounted on a gantry or support.

In an embodiment of the invention, as shown in FIG. 2, only a part of the device has been represented for an application of medical diagnosis by radiography and in a specific use configuration. Generally the entire device is mounted on a generally circular gantry or support P driven in rotation on an axis of rotation A centered on a body to be examined, between two successive rest positions in which the device is situated over an examining table on which the body is accommodated perpendicular to the table. In FIG. 2, the device is represented in active position, in the course of an image acquisition phase.

In FIG. 1 the device 10 is provided with means 22 for elimination or removal or extraction of gas bubbles contained in the liquid filling the protective enclosure 12. In operation, the X-rays generate, induce, cause, form or maintain chemical reactions in the liquid filling the protective enclosure 12. These reactions produce gases, such as hydrogen, propane, methane, etc., capable of altering or impairing the electric insulation properties of the liquid and of thus creating electric arcs within the enclosure, which can in turn may cause a cutoff or interruption of power to the cathode and a subsequent interruption or shutdown of X-ray emission.

For example, means 22 for elimination or removal or extraction of gas bubbles is mounted on a conduit 24 of a closed circuit for cooling the electrically insulating liquid (not represented) equipped with a pump ensuring a removal (which may be continuous) of the electrically insulating liquid by drawing the liquid from the protective enclosure and discharging it into the enclosure after cooling and elimination or removal or extraction of the gas bubbles.

Figure 3:
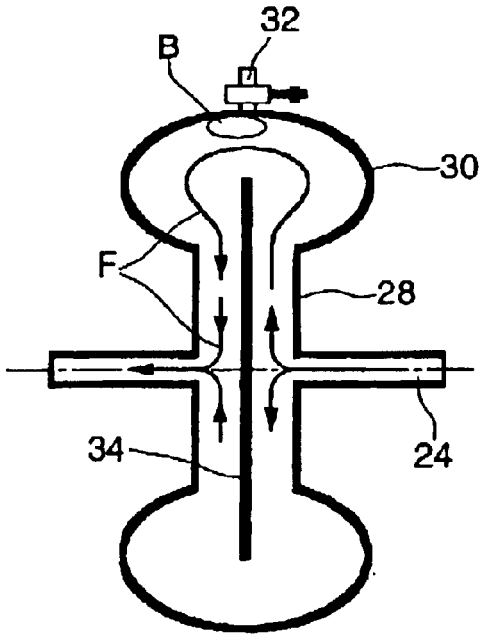
FIG. 3 is a side-face view of a means for elimination or removal or extraction of gas bubbles of the device of FIGS. 1 and 2.

Referring to FIGS. 2 and 3, in an embodiment of the invention, the means 22 for elimination or removal or extraction of the gas bubbles comprises a gas bubble trapping chamber 28. Chamber 28 is generally disk-shaped and is provided on the periphery with an annular cavity 30 of increased thickness equipped with a purge valve 32 for the chamber 28. Chamber 28 has an axis of symmetry generally extending parallel to the general axis A of rotation of the gantry or support P. As shown in FIG. 3, chamber 28 is provided internally with a generally disk-shaped flat plate 34. Plate 34 is arranged transversely, to the direction of flow of fluid in the conduit 24 and arranged coplanar to the general plane of the chamber 28. The plate 34 is dimensioned so that the periphery extends into the annular cavity 30 and defines in the cavity, together with a wall of the chamber 28, a conduit element for the flow and circulation of the electrically insulating liquid. Thus, and as shown by the arrows F, under the action of the means for pumping in the cooling circuit in which the chamber 28 is mounted, plate 34 directs the flow of incident liquid to the peripheral cavity 30 wherein the liquid and gaseous phases of the fluid filling the protective enclosure are separated and the gas is trapped. In FIG. 2, in which only the trapping chamber 28 has been represented, the device is mounted on the movable unit or gantry of the diagnostic apparatus.

In operation, the rotation movement imparted to the trapping chamber 28 causes the bubbles B to collect or migrate to the peripheral cavity 30 situated radially inward from the axis of rotation A of the device On interruption or stopping of the rotary support or gantry, the bubbles B migrate naturally to the top of the peripheral cavity 30 where the chamber is equipped with a purge or drain valve 32. For elimination or removal or extraction of gas bubbles thus trapped, it is sufficient simply to purge or drain the cavity 30. The drain valve 32 will be so positioned that it is situated at the top of the trapping chamber, in the rest position of the chamber.

Figure 4:
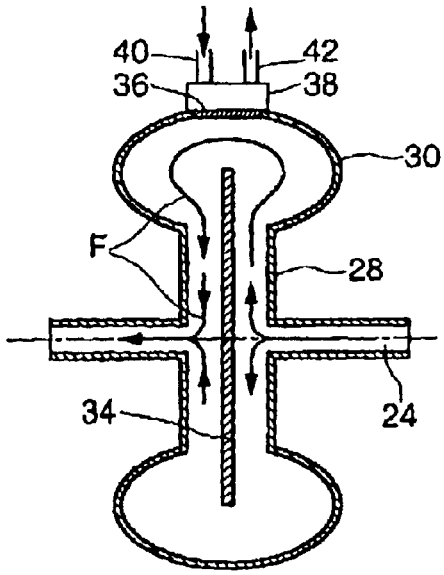
FIG. 4 is an example of use of an embodiment of a means for elimination or removal or extraction of gas bubbles.

In an embodiment of the invention, as shown in FIG. 4, in which elements identical to those of FIGS. 1 to 3 bear the same reference numbers, the purge or drain valve 32 can be replaced by a membrane 36 integrated with a wall of the chamber 28 and made of a material rendering it capable of being traversed by the gas molecules conveyed by the electrically insulating liquid.

In an embodiment of the invention, one of the wide faces of the membrane is intended to come in contact with the gas to be extracted or eliminated or removed, the other face being in contact with the ambient air. The material for the membrane can, for example, be palladium, platinum or an organic material such as PTFE (polytetrafluoroethylene) or PFA (perfluoroalkoxy). Under the effect of the osmotic pressure prevailing on both sides of the membrane, the gas molecules contained or dissolved in the electrically insulating liquid traverse the membrane and are discharged externally. The liquid is thus degassed without manual intervention.

In an embodiment of the invention, as shown in FIG. 4, the membrane is placed in a degassing chamber 38, comprising, for example, a wall of the chamber. The chamber is provided with inlets 40 and outlets 42 of a flow, which may be continuous, of carrier fluid capable of conveying the gas molecules passing through the membrane 36. Thus, the difference in osmotic pressure on both sides of the membrane allows a transfer of the gas molecules from the electrically insulating liquid to the carrier fluid.

Figure 5:
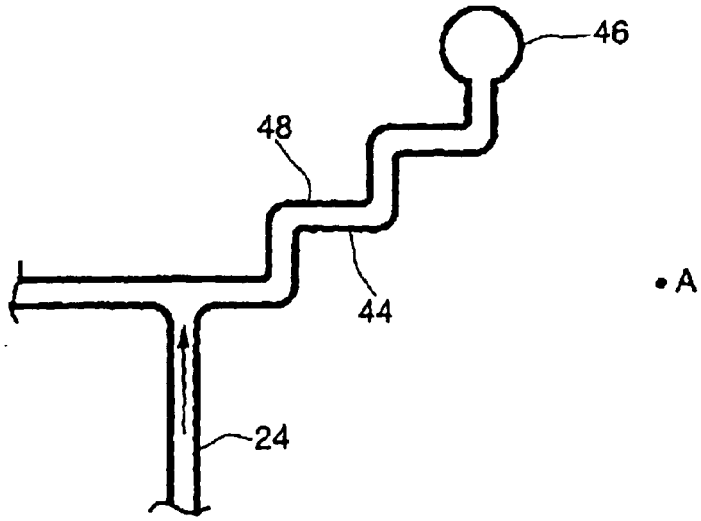
FIG. 5 is another embodiment of a means for elimination or removal or extraction of gas bubbles.

In an embodiment of the invention, as shown in FIG. 5, the means for elimination or removal of the gas bubbles are made in the form of a conduit element 44 extending substantially radially inward, considering the movement of the support P. from the conduit 24 of the cooling circuit. Conduit element 44 leads at an end into a gas bubble trapping cavity 46. Conduit element 44 is provided with elbows, such as 48, preventing the reintroduction of bubbles into the circuit after passage in the conduit element 44. The trapping cavity is provided with a purge or drain valve or a membrane as described with referrence to FIG. 4.

In operation, in the course of rotation of the gantry or support, the movement of the conduit element around the axis of rotation A produces a separation of the liquid and gaseous phases and migration of the gas bubbles to the trapping cavity 46, the elbows preventing a reintroduction of gas bubbles in the main flow of electrically insulating liquid. It is then sufficient simply to purge or drain the cavity, when the device is off, after an image acquisition phase.

The conduit element 44 is directed substantially radially inward and can be made in any shape, such as spiral, capable of producing a generally unidirectional course of the gas bubbles to the trapping cavity, during the displacement of the device on the gantry.

In the disclosed embodiments, the function of the device is both to trap gas bubbles appearing during operation of the device and the elimination or removal or extraction of the gas bubbles when the device has been returned to a rest position or, in the embodiment in which a membrane is used, during the operation of device.

In an embodiment of the invention, the device is provided with a single degassing chamber. It is possible to equip the device with several chambers—two, for example—placed in series in the cooling circuit of the electrically insulating liquid.

Trapping gas bubbles and elimination or removal or extraction thereof will substantially reduce the formation of electric arcs and therefore significantly increase the reliability of the device. The disclosed embodiments of the device makes it possible to avoid having to change periodically the electrically insulating liquid filling the enclosure and will therefore reduce maintenance operations.

One skilled in the art may make various modifications in structure and/or function and/or steps and/or manner and equivalents thereof to the disclosed embodiments without departing from the scope and extent of the invention.

What is claimed is:

1. An X-ray emission device comprising:

(a) an X-ray tube;

(b) a protective enclosure filled with an electrically insulating liquid, in which the X-ray tube is placed;

(c) means for elimination or removal or extraction of gas bubbles in the liquid filling the protective enclosure comprising a chamber that is generally disk-shaped and with a peripheral cavity; and (d) means for a purging or draining the chamber.

2. The device according to claim 1 wherein the means for elimination or removal or extraction comprises:

(a) at least one chamber that traps the gas bubbles in communication with the protective enclosure.

3. An assembly comprising the device and the chamber of claim 2 is movably mounted in a generally circular motion, the gas bubbles being trapped in a radially inward region of chamber, in the course of its displacement.

4. The device according to claim 3 wherein a transverse plate is disposed inside the chamber, plate causing the liquid to flow to a peripheral cavity.

5. The device according to claim 2 wherein a transverse plate is disposed inside the chamber, the plate causing the liquid to flow to a peripheral cavity.

6. The device according to claim 1 wherein the means of purging or draining the chamber comprises a valve placed in high position of the chamber.

7. The device according to claim 1 wherein the means for purging or draining comprises a filtration membrane placed in high position of the trapping chamber, the liquid filling the protective enclosure circulating against one of the faces of the membrane.

8. The device according to claim 7 wherein the peripheral cavity is an annular cavity and the filtration membrane is placed at a radially most outward position of the annular cavity.

9. The device according to claim 1 wherein a transverse plate is disposed inside the chamber, the plate causing the liquid to flow to a peripheral cavity.

10. The device according to claim 1 wherein the means of elimination or removal or extraction of the bubbles comprises:

(a) a conduit element in communication with the protective enclosure;

(b) the conduit element being in communication with the cavity; and (c) means for purging or draining located on the cavity.

11. The device according to claim 10 wherein the conduit element is elbowed.

12. The device according to claim 10 wherein the conduit element has at least one turn.

13. The device according to claim 1 wherein the means of eliminating or removal or extraction is mounted on a cooling circuit for the electrically insulating liquid.

14. The device according to claim 1 wherein the peripheral cavity is an annular cavity.

15. The device according to claim 14 wherein the means for purging or draining is placed at a radially most outward position of the annular cavity.

16. An X-ray emission device comprising:

(a) an X-ray tube;

(b) a protective enclosure filled with an electrically insulating liquid in which the X-ray tube is placed;

(c) the device being movable in operation in a generally circular motion;

(d) a generally disk-shaped gas bubble trapping chamber; the chamber having a peripheral cavity with a chamber purge or drain valve.

17. An X-ray emission device comprising:

(a) an X-ray tube;

(b) a protective chamber filled with an electrically insulating liquid in which the X-ray tube is placed;

(c) a pipe element connecting with the protective enclosure;

(d) a gas bubble cavity connected to the pipe element;

(e) wherein an assembly comprising the device and the pipe element being movably mounted in a generally circular motion;

(f) considering the path of the device, the pipe element during its movement, directing the gas bubbles in a radially internally manner towards the cavity; and (g) means for purging the cavity.

18. The device according to claim 17 wherein the pipe element is an elbowed pipe.

19. The device according to claim 17 wherein the pipe element has at least one turn.

20. The device according to claim 19 the gas bubbles being trapped in a radially inward region of the chamber, in the course of its movement.

21. The device according to claim 19 wherein the chamber is generally disk-shaped and with a peripheral cavity.

22. The device according to claim 17 wherein the means for purging or draining comprises a filtration membrane placed in high position of the chamber, the liquid filling the protective enclosure circulating against one of the faces of the membrane.

23. The device according to claim 17 wherein a transverse plate is disposed inside the chamber, the plate causing the liquid to flow to a peripheral cavity.

24. A method for elimination or removal or extraction of gas bubbles from a liquid of an X-ray emission device movable when operating in a generally circular motion, the device having an X-ray tube and a protective enclosure filled with an electrically insulating liquid in which the X-ray tube is placed comprising:

(a) removing the liquid filling the enclosure;

(b) passing the liquid into a gas bubble trapping chamber that is carried by the device, the chamber being provided with a peripheral cavity having a purge or drain valve;

(c) locking or closing the device and the chamber; and (d) purging or draining the chamber.

25. A method for elimination or removal or extraction of gas bubbles from a liquid of an X-ray emission device movable when operating in a generally circular motion, the device having an X-ray tube and a protective enclosure filled with an electrically insulating liquid in which the X-ray tube is placed comprising:

(a) removing the liquid filling the enclosure causing the gas bubbles to pass into a pipe conduit that substantially extends radially inward and has at least one turn;

(b) causing the rotation of the conduit on an axis of rotation different from the rotation of the device such that the gas bubbles are directed into a gas bubble trapping cavity;

(c) locking or closing the device; and (d) purging or draining the cavity.

* * * * *